United States Patent [19]

Maroino

[11] 4,429,723

[45] Feb. 7, 1984

[54] YARN BRAKING MEANS FOR YARN FEEDING DEVICES

[75] Inventor: Adriano Maroino, Gaglianico, Italy

[73] Assignee: Roj Electrotex S.p.A., Biella, Italy

[21] Appl. No.: 311,752

[22] Filed: Oct. 15, 1981

[30] Foreign Application Priority Data

Oct. 15, 1980 [IT] Italy ..... 25350 A/80

[51] Int. Cl.[3] ..... D03D 47/36

[52] U.S. Cl. ..... 139/452; 242/47.01; 242/128; 242/147 R

[58] Field of Search ..... 139/452; 242/47.01, 242/128, 147

[56] References Cited

U.S. PATENT DOCUMENTS 3,411,548 11/1968 Pfarrwaller ..... 139/452
3,759,300 9/1973 Pfarrwaller ..... 139/452
3,995,786 12/1976 Deniega ..... 139/452
4,153,214 5/1979 Savio et al. ..... 242/47.01
4,186,897 2/1980 Brown ..... 242/147

*Primary Examiner*—Henry Jaudon
*Attorney, Agent, or Firm*—Young & Thompson

[57] ABSTRACT

A device for feeding yarn with a constant adjustable tension, for use in weaving looms and in other weaving machines, comprises a brake acting on an end cap of the winding drum—held stationary—of the device. The brake is a plurality of elastically yielding metal elements, positioned radially in a support designed to envelope the cap and mounted with possibility of self-centering in respect of the cap, these elements engaging the outcoming yarn about a circumferential area of the cap having a slightly smaller diameter than that of the winding drum of the feeding device.

2 Claims, 6 Drawing Figures

YARN BRAKING MEANS FOR YARN FEEDING DEVICES

BACKGROUND OF THE INVENTION

The present invention relates to a device for feeding yarn with a constant adjustable tension, for use in weaving looms and in other weaving machines, wherein important improvements have been introduced in the means for braking the outcoming yarn.

The yarn feeding device to which the present invention refers is of the type comprising a substantially cylindrical body or drum, onto an end of which are wound the turns of the yarn to be fed by means of a winding arm, the turns being then led axially forward by suitable means and being unwound at the opposite end by the weaving machine, particularly a weaving loom.

The tension of the unwinding yarn is controlled by braking means adapted to guarantee a constant and even tension when the machine is working.

In the so far known devices of this type, the tension of the unwinding yarn is controlled by braking means which often consist of a brush cooperating with the outer base of the cylindrical body or winding drum from which the yarn unwinds and which is mounted on a suitable external support.

The brush consists of a circular ring from which project, either in continuous form or arranged in bundles, more or less long bristles—usually of synthetic material—having a constant or variable inclination, for the purpose of obtaining an adjustment of the yarn tension.

However, an increased or reduced pressure of the brush on the drum of the feeder keeps the adjustment of the yarn tension within rather limited ranges, while the bristles of the brush get quickly worn, especially when working with abrasive yarns, and the brush itself undergoes a certain deformation, especially if one tries to obtain a high tension, as required for thick yarns; finally, the bristles of the brush become inpregnated, when working with yarns which deposit along their path the substances with which they have been previously treated during the spinning operations.

The consequence of all these inconveniences is an irregular tension of the outcoming yarn. It so happens that, in most cases, the brush braking means are merely used to stop or limit the forming of balloons in the unwinding yarn, and that the function of adjusting the tension is then performed by other means.

Other known braking means in the yarn feeding devices provide for the use of a plurality of substantially radial elements of thin sheet-metal, which are elastically pressed against the outer base of the winding drum in order to adjust the tension of the unwinding yarn.

In such braking means, the sheet-metal elements are retained at the ends between a ring and a hub of plastic material, said ring and said hub being also connected by radial elastic laminae.

These means practically eliminate all the drawbacks of the brush brakes; however, since they act substantially in a radial sense, they have the inconvenience of having their contact area with the outer base of the cylindrical winding body generally about a circumference which has a far smaller diameter than that along which the winding of the yarn turns takes place, it being appropriate for the rim of the winding body to comprise a wide fillet between the lateral surface and the base of the cylinder itself. This very much limits the action of stopping the balloon of unwinding yarn, which such means are adapted to accomplish. Moreover, in those feeding devices wherein the direction of advancement of the turns is the same as the direction of movement of the outcoming yarns, the use of radial sheet-metal braking means forces the outcoming yarn to deflect through a total angle of more than 180°, in order to pass from the cylindrical winding body onto the axis along which the yarn gets drawn, thereby subjecting the yarn itself to a higher stress compared to the other known brush braking means, where said angle does not usually exceed 90°.

SUMMARY OF THE INVENTION

The braking means for yarn feeding devices, according to the present invention, overcome the heretofore mentioned drawbacks and allow a very even braking action. They are of the type designed to act on the end cap of the winding drum—held stationary—of the feeding device, and they are characterized in that they comprise a plurality of elastically yielding metal elements, positioned radially into a support designed to envelop said cap and mounted with possibility of self-centering in respect of said cap, said elements engaging the outcoming yarn along a circumferential area of the cap having a slightly smaller diameter than that of the winding drum of the feeding device.

According to a preferred embodiment, said metal elements are substantially radial sheet-metal blades, arranged to form a frustoconical surface and mutually connected about the major circumference of said surface; from the area of mutual connection, the blades emerge into an inclined position in respect of the generating lines of the frustoconical surface and they are then deviated along said generating lines at their inner free end.

According to another preferred embodiment of the invention, said blades are mounted in an open cup-shaped support of plastic material, the peripheral connection area of said blades being anchored—by means of an elastic deformable ring—in an inner seat provided on the rim of wider diameter of said cup-shaped support, the free ends of said blades bearing on the rim of smaller diameter of the same cup-shaped support. The cup-shaped support is mounted suitably articulated between the ends of the branches of a fork, said ends engaging diametrally opposed points of said support and said fork being carried—oscillating about an axis perpendicular to the oscillation axis of the support and to the longitudinal axis of the device—by a movable arm.

BRIEF DESCRIPTION OF THE DRAWINGS

The invention will now be described in detail, by mere way of example, with reference to the accompanying drawings, in which:

FIG. 4 shows a detail of the mounting of said set of blades in the support therefor; while

DESCRIPTION OF THE PREFERRED EMBODIMENT

Figure 1:
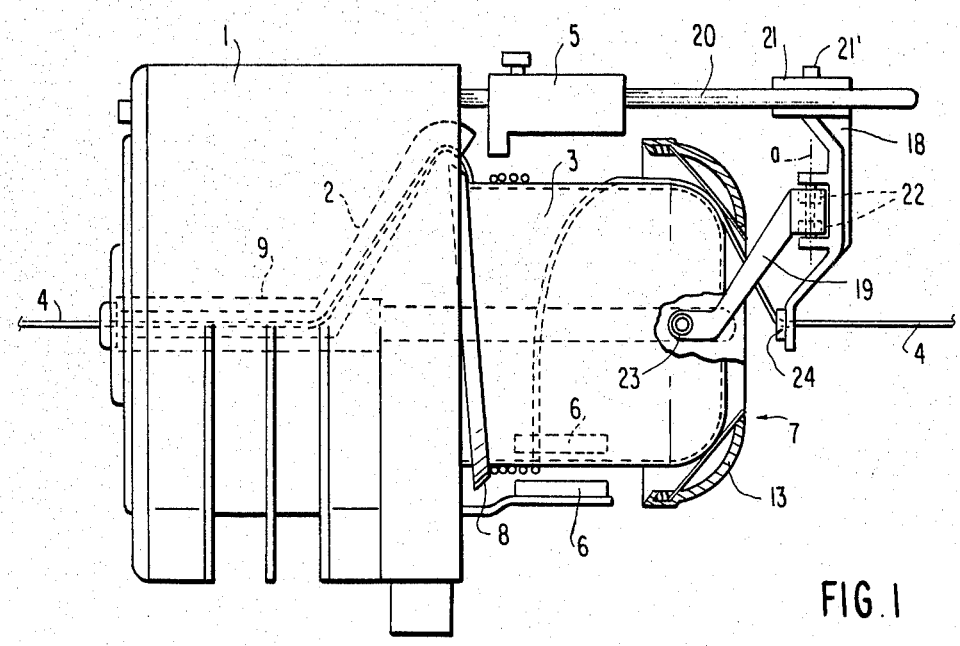
FIG. 1 is an axial section view of a yarn feeding device provided with braking means according to the invention.

FIG. 1 illustrates a feeding device which comprises, inside a casing 1, an electric driving motor and an electronic control circuit (not shown), as well as a winding arm 2 and, externally, a cylindrical body 3 or drum for winding the yarn 4, means 5 for detecting the amount of yarn wound on the body 3, magnetic means 6 for preventing the rotation of the body 3, and means 7 for braking the outcoming yarn 4. Partially inside the casing 1 and partially on the outside thereof a disc 8 is provided to lead forward the yarn turns winding on the body 3.

The winding arm 2 consists of an inclined extension, with bent end, of the shaft 9 of the electric driving motor, said shaft 9 and said arm 2 being hollow for the yarn 4 to slide therein. On the shaft 9 is moreover mounted, freely rotating on bearings, the cylindrical body or winding drum 3, which is prevented from rotating by the pair of magnets 6, one fixedly connected to the casing 1 and the other carried by said body 3.

Figure 3:
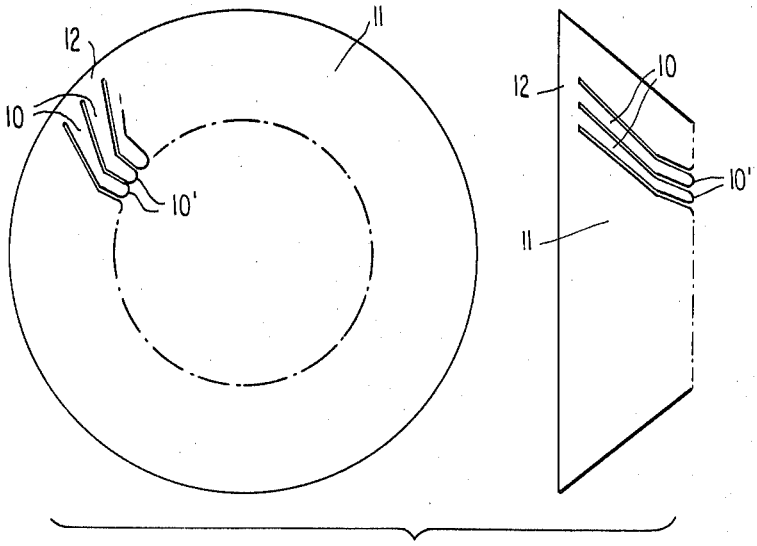
FIG. 3 shows two views of a detail of the set of braking blades.
Figure 4:
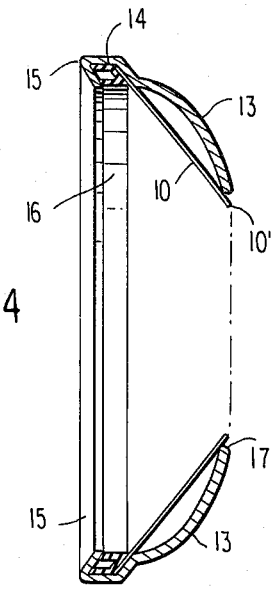

According to the invention, the braking means 7 comprise a plurality of substantially radial sheet-metal blades 10, arranged to form a frustoconical surface 11 (FIG. 3) and mutually connected the major circumference 12 of said surface, and a cup-shaped support 13 of plastic material (FIG. 4).

The blades 10 depart from the area of mutual connection 12 in an inclined position in respect of the generating lines of the frustoconical surface which they form, and they then follow the direction of said generating lines in correspondence of their free end 10′ close to the minor circumference of said surface. The inclination of the blades is determined so that it may follow as far as possible the direction of movement of the yarn along the edge of the winding drum 3.

The set of sheet-metal blades forming the frustoconical surface 11 is housed, with its connection area 12 of greater diameter, in a peripheral seat 14 provided inside the rim of greater diameter 15 of the cup-shaped support 13, and is fixed in said seat by means of an elastic ring 16, also of plastic material.

The free ends 10′ of the blades bear on the rim of smaller diameter 17 of said support 13, so that each blade is adapted to behave as an elastic element similar to a leaf spring. The cup-shaped support 13, with the set of blades 10, envelops the free end—appropriately cap-shaped—of the cylindrical winding body 3, the mounting system adopted being adapted to guarantee the self-centering of the support and thereby a perfect evenness of the braking action on the yarn 4 about the whole periphery of said body 3.

The support 13 is mounted by means of an arm 18 with fork 19 carried, adjustably as to its position in the direction of the longitudinal axis of the device, by a rod 20 fixedly connected to the casing 1, to which are also fixed the means 5 for detecting the amount of yarn wound on the drum 3 of the device itself. The arm 18 is connected to the rod 20 by way of a slide 21, adapted to be locked by screw means 21′, and it carries the fork 19 mounted oscillably, by means of bearings 22, about an axis a perpendicular to the longitudinal axis of the device. The fork 19 carries in turn the support 13 mounted oscillably about an axis perpendicular both to the longitudinal axis of the device and to the axis a around which is oscillably mounted the fork itself. The latter axis, which passes through the barycenter of the unit formed by the support 13 and blades 10, is defined by two bearings 23 which are mounted, in diametrally opposed positions, on the rim of greater diameter 15 of the support 13.

The possibility to oscillate about two axes and gives to the braking means 7 a fully articulated mounting arrangement, enabling the sheet-metal blades 10 to impart an even pressure on the radiused part of the cap of the winding body 3 and thereby guaranteeing an even and adjustable tension of the yarn 4 crossing the device, whatever the position taken up by said yarn—moment by moment—along the periphery of the body 3.

In operation, the yarn 4 enters the device through the hollow shaft 9 of the motor, gets wound into several turns (controlled by the means 5 which detect their presence and adjust the running of the motor) by the winding arm 2, passes between the curved periphery of the cap end of the body 3 and the blades 10 of the braking means 7, and comes out through a ceramic eyelet 24. The braking power, and thus the tension of the yarn 4, may be easily adjusted by shifting the slide 21 along the rod 20, so as to move the braking means 7 away from or close to the drum 3, thereby pressing the blades 10 of such means more or less strongly against the end cap of said body. Under any working conditions, the braking means 7 are perfectly centered, or they are adapted to self-center in response to any situation which may tend to alter their trim.

As heretofore specified, the braking is extremely even and it can be adjusted in an exceptionally responsive way. Furthermore, such braking is effected about a peripheral area at the end of the yarn winding body 3, which has a diameter very close to the greatest diameter of said body 3, and it subjects the yarn to very limited deviations along its path from the winding drum to the ceramic eyelet drawing said yarn, thereby eliminating the drawbacks of the already known braking devices with radial metal elements.

Figure 2:
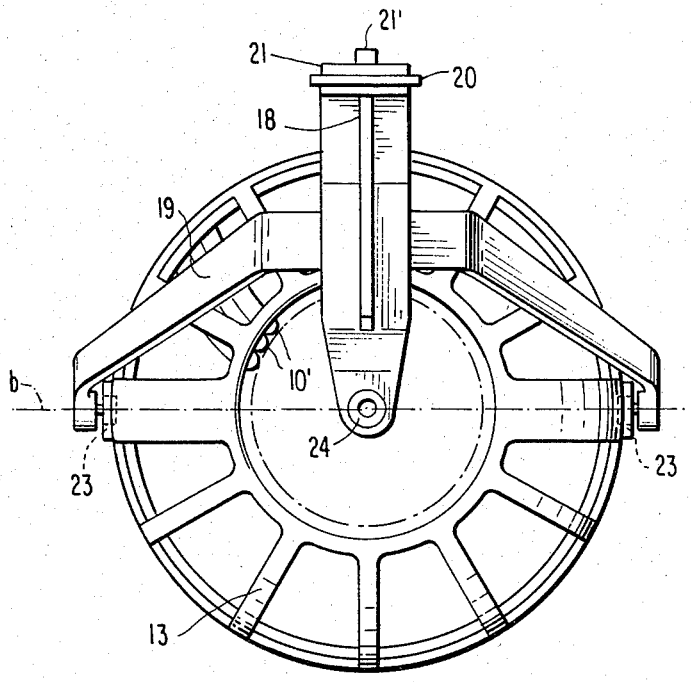
FIG. 2 is an external front view of the braking means mounted on the device of FIG. 1.
Figure 5:
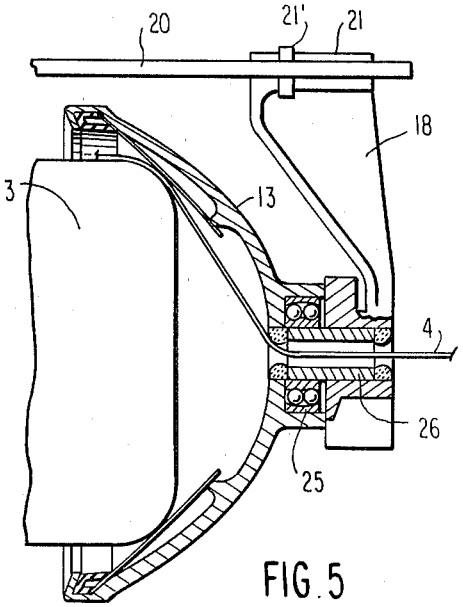
FIGS. 5 and 6 show diagrams of two possible embodiments of the braking means according to the invention.

The heretofore described articulated mounting system of the braking means 7 may of course be replaced by other mechanical systems allowing the elements 10 to take up a free position, taking into account that they should in any event correct small angular errors. By way of example, FIG. 5 shows diagrammatically a different mounting system from that shown in FIGS. 1 and 2, consisting of a self-adjusting radial ball bearing 25, which carries the support 13 of the braking means 7 on the outer thrust block and which has its inner thrust block keyed to a shaft 26 tied to the arm 18, the shaft 26 being hollow to let through the outcoming yarn 4.

Figure 6:
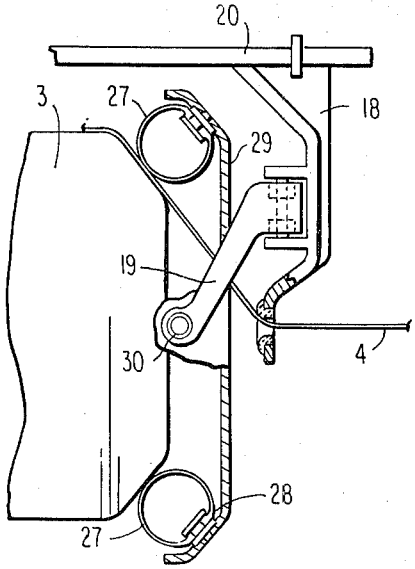

Even the plurality of thin sheet-metal blades may be replaced by other yielding elements adapted to engage the drum 3 on the periphery of its cap. By way of example, FIG. 6 shows schematically a different embodiment of braking metal elements. This embodiment makes use of a garter spring 27 formed of a plurality of thin sheet-metal elements, mutually connected at the two ends 28, and rolled up first in the form of a cylinder and then around itself. The garter spring 27 is fixed on a support 29 which is in turn tied to the fork 19 by means of bearings 30. The fork 19 is mounted on the arm 18, and this latter on the rod 20, as in the embodiment of FIGS. 1 and 2.

It is to be understood that there may be still further embodiments of the invention, and that any variants and modifications of those heretofore described may easily be used by those in the art, all such embodiments evidently falling within the scope of the present invention.

I claim:

1. Means for braking the yarn coming out of devices feeding said yarn to weaving machines with a constant adjustable tension, of the type acting on an end cap of a stationary winding drum of a said device, comprising a plurality of elastically yielding metal elements, positioned radially in a support that envelops said cap and is self-centering in respect of said cap, said elements engaging the outcoming yarn about a circumferential area of the cap having a slightly smaller diameter than that of the winding drum of the feeding device, said metal elements being substantially radial sheet-metal blades, arranged to form a frustoconical surface and mutually connected along the major circumference of said surface, said blades being mounted in an open cup-shaped support of plastic material, the peripheral connection area of said blades being anchored by means of an elastic deformable ring in an inner seat on the rim of wider diameter of said cup-shaped support, the free ends of said blades bearing on the rim of smaller diameter of the same cup-shaped support.

2. Means for braking the yarn coming out of devices feeding said yarn to weaving machines with a constant adjustable tension, of the type acting on an end cap of a stationary winding drum of a said device, comprising a plurality of elastically yielding metal elements, positioned radially in a support that envelops said cap and is self-centering in respect of said cap, said elements engaging the outcoming yarn about a circumferential area of the cap having a slightly smaller diameter than that of the winding drum of the feeding device, said support for the metal elements being mounted articulatedly on an arm which can be shifted parallel to the longitudinal axis of the feeding device, between the ends of the branches of a fork, said ends engaging diametrally opposed points of said support and said fork being mounted oscillatingly about an axis perpendicular to the oscillation axis of the support and to the longitudinal axis of said device on said shiftable arm.

* * * * *